United States Patent [19]

Charney et al.

[11] Patent Number: 4,522,364

[45] Date of Patent: Jun. 11, 1985

[54] DESK TOP

[76] Inventors: Gregory S. Charney, 605 NE. Liberty, Portland, Oreg. 97211; Terrance D. Hohner, 1090 SW. Gaines, Portland, Oreg. 97201

[21] Appl. No.: 471,857

[22] Filed: Mar. 3, 1983

[51] Int. Cl.[3] ..... F16F 15/00

[52] U.S. Cl. ..... 248/460

[58] Field of Search ..... 248/460; 245/454–458, 245/460–465

[56] References Cited

U.S. PATENT DOCUMENTS

| | | | |
|---|---|---|---|
| 681,976 | 9/1901 | Rathvon | 248/456 |
| 1,839,291 | 1/1932 | Barbour | 248/460 |
| 3,833,098 | 9/1974 | Alderman | 248/460 |
| 3,980,266 | 9/1976 | Jones | 248/460 |
| 4,044,980 | 8/1977 | Cummins | 248/460 |

FOREIGN PATENT DOCUMENTS

| | | | |
|---|---|---|---|
| 8124 | of 1902 | Austria | 248/460 |
| 10349 | 1/1902 | Norway | 248/460 |
| 8145 | of 1908 | United Kingdom | 108/43 |

*Primary Examiner*—Reinaldo P. Machado
*Assistant Examiner*—Alvin Chin-Shue
*Attorney, Agent, or Firm*—Robert L. Harrington

[57] ABSTRACT

A desk top having a first inclined surface adapted as a writing surface and a second surface, starting at the rear edge of the writing surface and inclined relative thereto, adapted as a reading surface. A lip is provided at the juncture between the surfaces for holding a book or the like.

4 Claims, 6 Drawing Figures

FIG. 1
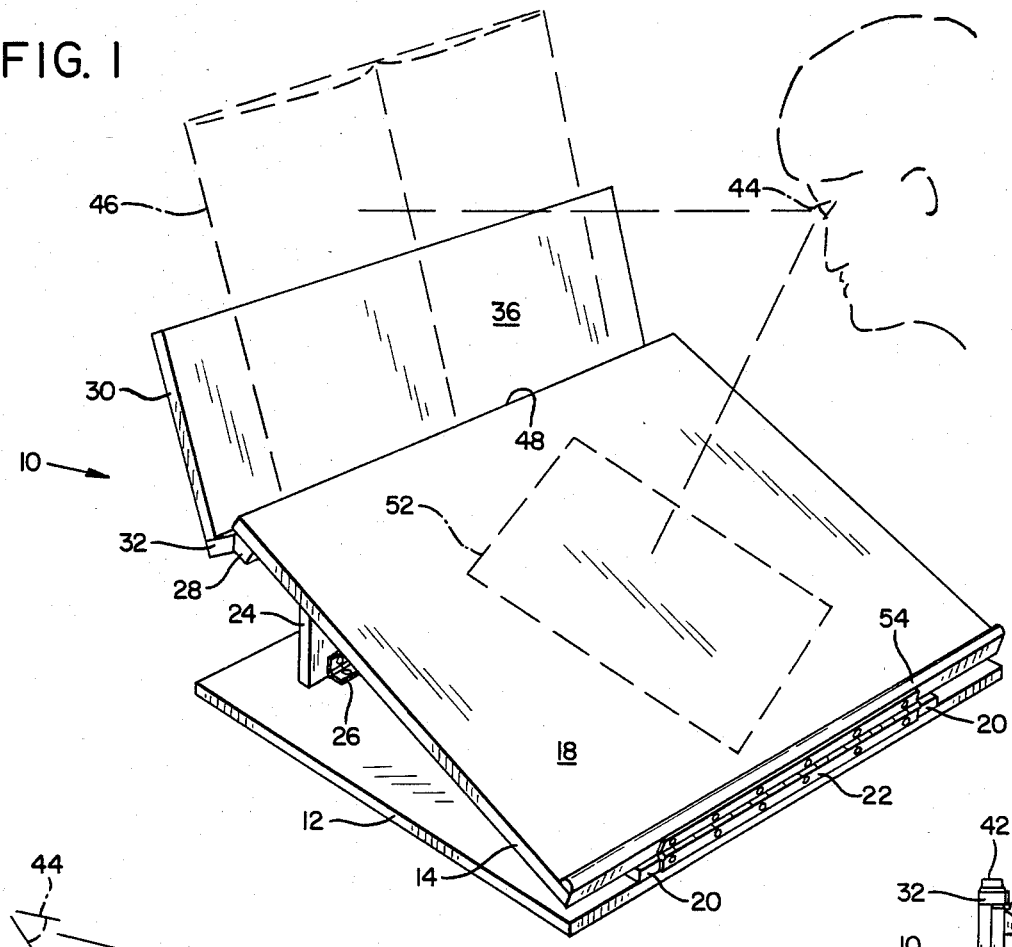
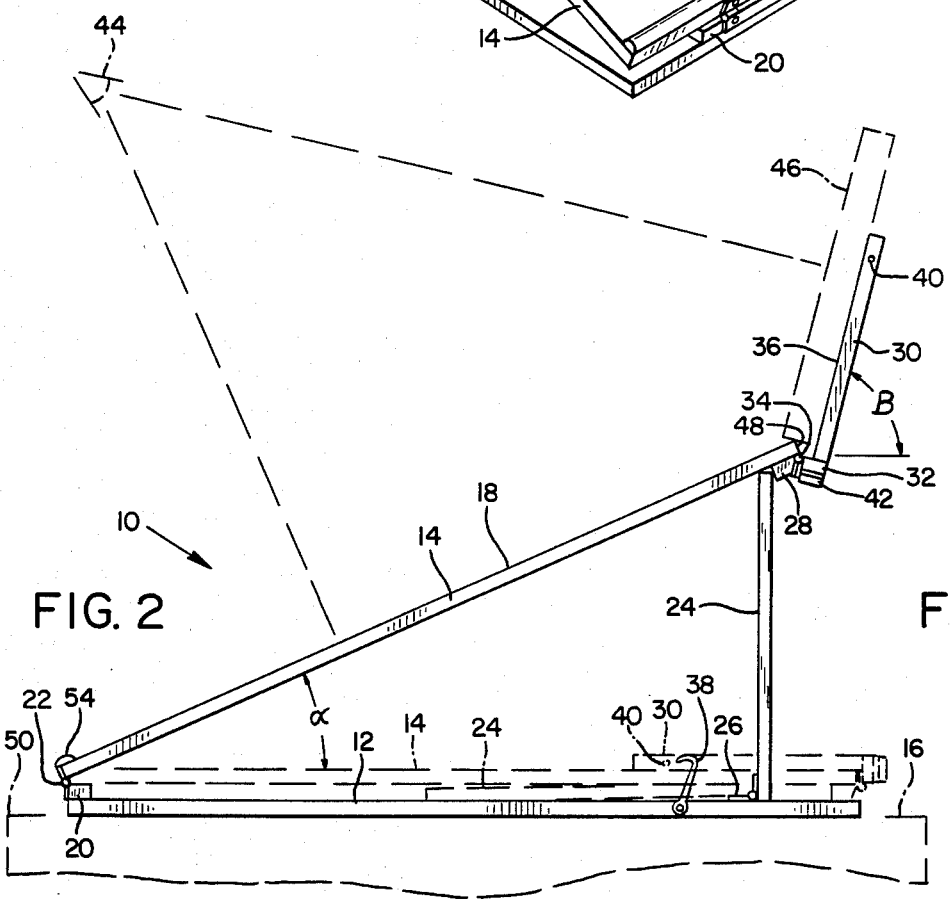
FIG. 2
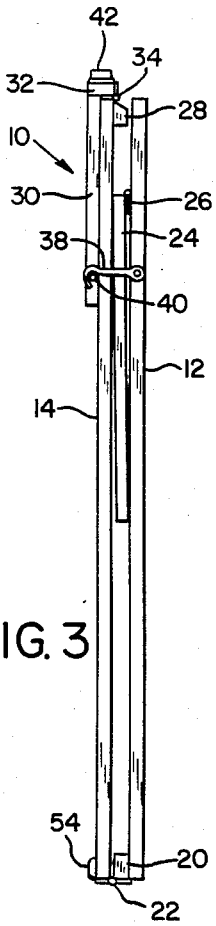
FIG. 3

DESK TOP

This invention relates to a desk top designed to accomodate the writing and reading needs of the desk user while providing optimum eye care for that user.

BACKGROUND OF INVENTION

It is a well known fact that persons who do a lot of reading and writing are far more likely to develop eye problems. Notably a weakness develops that is understood by the layman to be nearsightedness. As the worlds' population has become more academic, the incidence of nearsightedness has become greater and greater. In the United States today, about 40% of the population is nearsighted and that number is growing.

Among the beliefs of the layman is the idea that nearsightedness is an inherited weakness, or to some, that nearsightedness is the price you pay for an education. Both are erroneous to a large extent. It rarely is a result of an inherited weakness and it occurs most frequently in those persons who read and write a lot, because they do so improperly.

The eye is truly an amazing organ of the human body. It can focus on near objects, as close as a couple of inches, and on far objects, as far as a couple of miles, and everything in between. It encompasses a field of vision of close to 180° and it rapidly adjusts to movement side to side and near to far. To accomplish these amazing adjustments, literally dozens of muscles are brought into play.

Reading improperly generates a greater stress on the human lens and eye muscles than any other activity. Consider a person typically reading a book that is lying on a flat desk top. The nearest edge of the book will generally be some 7 or 8" away from the readers eyes and the far edge of the book some 15 to 18" away from the eyes. Focusing on close objects is extremely hard on the eye muscles. Anything closer than 14" generates a focusing difficulty that is geometrically progressively more difficult with each inch. Furthermore, as the reader reads up and down the page, page after page, his eyes must focus on the words at the 18" distance down to the 7" distance, back to the 18" distance and on and on. Reading under these conditions induces lens and muscular stress that can, and often does, result in nearsightedness.

BRIEF DESCRIPTION OF THE INVENTION

An attempted solution to the problem of desk top reading has been available for years in the form of a desk prop or stand. The book is propped up to reduce the variation in the distance from the eyes, but it does not control the overall distance and it does not offer a solution for the writer. Another such attempted solution can be found in the form of a draftsmans table which is tilted toward the user and thus attempts to alleviate the variation in the distance from the eyes during drafting or writing. Again no attempt is made to control the overall distance and the draftsmans table, being geared to the writers comfort, is at a lesser angle than the book prop and is not suitable for reading.

The preferred embodiment of the present invention was developed to achieve optimum conditions necessary to minimize eye muscle strain during reading and writing, but considering the practical limitations of habits, comfort, writing and reading material size and availability, etc. The ultimate reading and writing conditions would require a structure tailored to each persons particular physical characteristics, including height, eye condition, arm length etc. Then the reading and writing materials would have to be redesigned providing different type size, paper size etc. The display platform would take the form of the inside of a hemisphere with the reader or writers head fixed to insure equal distance from the users eyes to the various points on the display platform. Finally, there would be adjustments in the lighting, optimum contrast between reading material and the background, etc. The achievement of such ultimate conditions would be useless and the present invention accordingly compromises the ultimate eye care conditions for a practical solution that is believed readily adaptable to the typical conditions of a large percentage of the population, i.e., those striving for academic goals including all ages of students.

In brief, the present invention is designed to achieve a display surface for the user that conforms as closely as practical to the eyes horopter, i.e., the curved surface that is established by a constant distance from the eyes as they normally scan up and down, as in reading. (A horopter normally encompasses side to side movement but in the preferred embodiment, accomodating side to side curvature is considered impractical). In the preferred embodiment of the invention, two relatively flat surfaces are provided, the first being angled relative to a flat desk top and is primarily designed as a writing surface. The second surface starts at the back of the writing surface and is angled upwardly from the first surface and is primarily designed as a reading surface.

This improved desk top is adaptable for placement on a typical flat desk top with the desk users eyes located generally above the edge of the desk at a height above the flat top a distance of 10 to 15". A first platform is designed to rest on the flat surface of the desk with the front edge thereof starting 2 to 5" forward of the desk edge (depending on the thickness, if any, of the desk top support). The rear edge of the platform is positioned on the desk about 16 to 20" from the front edge, i.e., the platform has a depth of about 15". This measurement provides for adequate surface space for the typical writing materials and positions the base of the reading surface a comfortable 16 to 20" from the users eyes. The angle of incline on the first surface is optimially in the range of 20° to 30° from the flat desk top which produces a height at the back of this first platform of about 6 to 7 inches. The incline of the second surface, provided on a second platform, is considerably steeper and ranges between 60° and 80° from the flat desk top and extends upwardly for about 5 inches. A ledge or lip is provided between the two platforms which is adapted to support a book or the like.

DETAILED DESCRIPTION INCLUDING DRAWINGS

The interconnected platforms with inclined surfaces as above described, provides for far better eye care than any desk top heretofore known to the inventors. It is practical, easy to assemble, and closely satisfies the horoptic curvature that is so desirable for minimizing eye strain. Furthermore, it lends itself to fold-up assembly and thus portability, all of which will be more apparent by reference to the following detailed description and drawings wherein:

FIG. 1 is a perspective view of a preferred embodiment of an improved desk top of the invention with phantom lines illustrating the head of the user and reading and writing materials positioned on the desk top;

FIG. 2 is a side view of the improved desk top; and

FIG. 3 illustrates the desk in folded condition for carrying;

Figure 4:
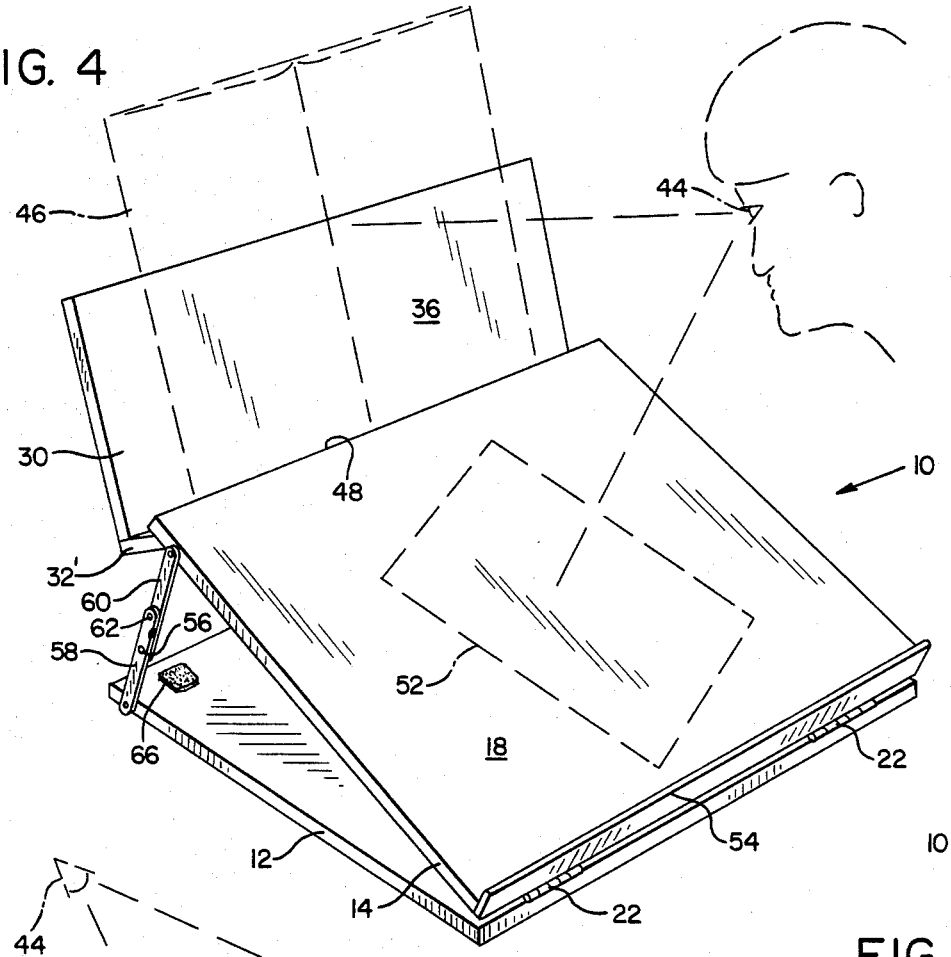
FIGS. 4, 5 and 6 are views similar to FIGS. 1, 2, and 3 respectively but of a different embodiment of the invention.

Referring to the drawings, a desk top 10 includes a base 12 and a first platform 14. Base 12 is adapted to rest on a flat desk top 16 and platform 14 includes exposed surface 18 that is inclined at an angle alpha of 20° to 30° relative to the base 12 and flat desk top 16. A spacer block 20 fixed to the front edge of the base 12 is fastened to one leg of a hinge 22 and the other leg of hinge 22 is fastened to the front edge of the platform 14 to thereby pivotally attach the platform 14 and base 12 together.

A support member 24 is similarily hinge connected to the base 12 adjacent the back edge of the base by hinge 26 which permits 90° movement of the board from its full upright or perpendicular position as shown in full lines in FIG. 1 and 2, to a full collapsed position as shown in FIG. 3 and in phantom lines in FIG. 2. In the upright position, the member 24 engages and supports the upper or rearward end of platform 14. It will be understood that the height of member 24 is designed relative to the distance between hinge connections 22 and 26 (taking into consideration the height of spacer block 20) to achieve the desired 20° to 30° angle of alpha. A locater block 28 on the upper bottom edge of platform 14 provides a stop for the upper end of support member 24.

In an actual model of the preferred embodiment, the height of the support member 24 is $5\frac{3}{4}$ inches. The distance between the hinges is approximately $11\frac{1}{2}$ inches and the spacer block height is $\frac{1}{2}$ inch to produce an angle alpha of about 25°. With support member 24 in the collapsed position, the platform 14 folds flat against spacer block 20 and support member 24 as shown in phantom lines in FIG. 2 and in full lines in FIG. 3.

A second platform 30 is provided at its bottom edge with a strip 32 that is as wide as the width of platform 30 and 14 combined. The platforms 30 and 14 are pivotally connected through the connection of hinge 34 having one leg connected to the upper end edge of platform 14 and the other leg connected to the side edge of strip 32. As can be seen from FIGS. 1 and 2, the locater block 28 has the further function of providing a pivotal stop for platform 30, achieved when the engaging faces of strip 32 and block 28 are in abutment. This locater block is designed in conjunction with strip 32 to stop pivotal movement of platform 30 to establish a relative angle between surface 18 of platform 12 and the surface 36 of platform 30 of 129°, which provides a 76° angle beta relative to the flat desk top 16.

As will be seen again from the phantom lines of FIG. 2 and in the full lines of FIG. 3, the hinge connection 34 permits the platform 30 to be folded flat against the platform 18. A latch hook 38 fixed to base 12 is adapted to engage a latch pin 40 on platform 30 to releasably secure the desk top in its folded condition for carrying. A handle 42 connected to the outer edge of strip 32 is adapted for aiding the user in carrying the desk top in its folded condition.

OPERATION

It will be apparent from the foregoing that this preferred embodiment of the invention is designed to be carried by a student from class to library to home with ease. It is further designed to be readily unfolded and placed on a flat desk top or table which in general, positions the eyes 44 of the reader at approximately the same level with the top of a book 46 placed on platform 30. With the platform 36 spaced rearwardly from the back edge of platform 14 (by reason of strip 32 being wider than the platform 30), a lip 48 is provided on which to rest the book.

The improved desk top is positioned on the flat desk to provide the user with a comfortable writing surface 18. This generally is achieved when an imaginary continuation of surface 18 intersects the flat table top at desk edge 50 as shown in FIG. 2. Positioning of a paper 52 on this surface 18 is illustrated in FIG. 1 and a ledge 54 is provided to prevent the paper or pencils from sliding off the surface.

Other features that are provided for this improved desk top is the provision of a color contrast for surfaces 18 and 36 in the order of 2 or 3 times the contrast of white paper. This contrast is recommended under lighting conditions of 30 to 70 foot candles. The desired contrast for surfaces 18 and 36 are achieved with a light wood material such as oak and it has been found that eye strain is further eased by running the grain structure in a left to right orientation on the surfaces.

OTHER EMBODIMENTS OF THE INVENTION

Figure 6:
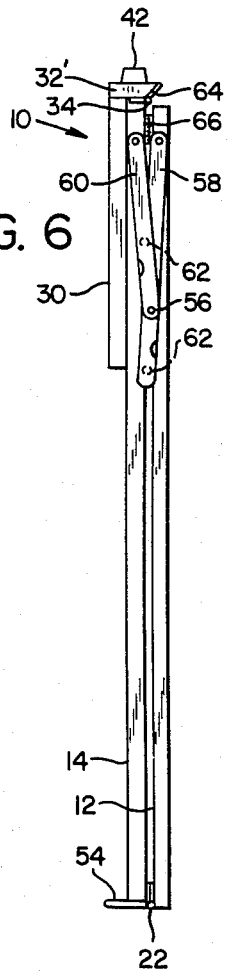
Figure 5:
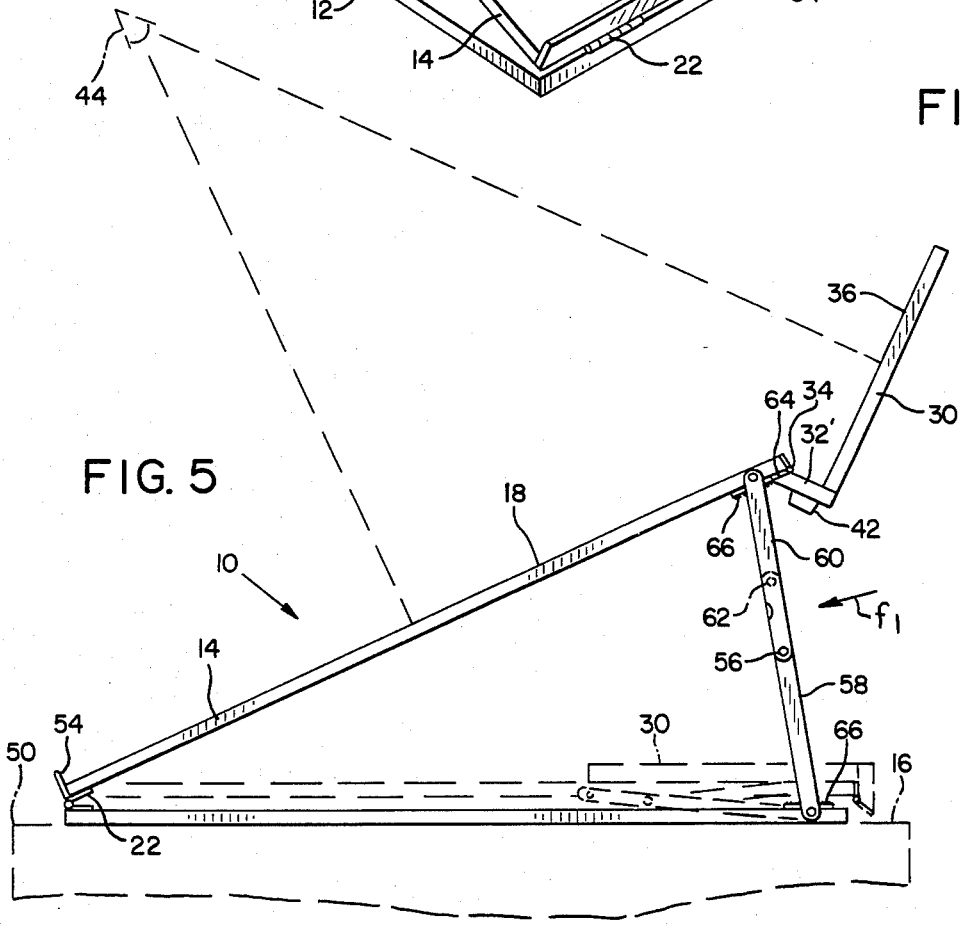

FIGS. 4, 5, and 6 illustrate a simplified version of the desk top of FIGS. 1 through 3. The basic components are the same and thus a platform 14 is connected at one end to a base 12 by a hinge connection 22. The raised end of the platform 14 is supported by a folding hinge which is different from the support member of the first embodiment. Folding hinges such as illustrated are common and consist of two rigid straps 58 and 60 that are pivotally connected together at 56, with the strap 58 pivotally connected at its other end to base 12 and strap 60 pivotally connected at its other end to platform 14. As illustrated, strap 58 has its first end extended beyond the interconnection with strap 60 and this end overlaps with the shank of strap 60 when in the open position. Frictional engaging fingers 62 are provided on the extended end of strap 58 and the shank of strap 60 and are adapted to interengage when the hinge is in the open position as shown in FIG. 5. The hinge thus resists collapsing in the open position until a sufficient force $F_1$ is applied at the interconnecting point 56 to disengage the fingers 62.

The strip 32 is modified in this simplified embodiment by its extension and angled facing 64 adapted to engage the underside of platform 14 in a manner to establish the desired angle. A fabric fastener 66 is provided on the underside of platform 14 and the top of base 12 which interengage and secure the components in a folded condition as shown in FIG. 6. It will be noted that as compared to the embodiment of FIGS. 1 through 3, the desk in folded condition is thinner by the elimination of blocks 20 and 28 and the support member 24 (the folding hinge folds to the side of the table top). It is also easier to construct with less materials and is thus lighter to carry and cheaper to manufacture.

This invention is believed to offer the opportunity to turn around the trend toward poorer eyesight. It induces reading posture that greatly eases the strain on the eyes and also reduces fatigue to neck, shoulder and upper arm muscles. The reader will quite naturally, in his use of the multi-angled desk top of this invention, sit in a posture alignment that is more conducive to greater relaxation. Note that the user requires less or no effort of the arms and shoulders in holding the reading material and he avoids misalignment of head and spine, caused by holding ones head down while reading on a flat surface. It is even believed that reducing this body stress can have a beneficial affect on reducing visual fatigue.

Whereas the embodiments described herein are the preferred embodiments, with unique features particularily desirable for the student, e.g., portability, it will be appreciated that a variation whereby the components are fixed on a stationary desk is also encompassed in the broader concept of the invention. Other variations and modifications will undoubtedly become apparent to those skilled in the art on becoming familiar with the concepts as described herein, and this invention is accordingly intended to encompass such modifications and variations as provided by the claims appended hereto.

We claim:

1. A portable desk top adapted to rest on a support surface comprising; a first platform having a top surface and an upper edge, a first foldable support means for the first platform having an open position for supporting the first platform with the top surface inclined front to back relative to the support surface, a second platform having a top surface, and a second foldable support means supporting the second platform at the upper edge of the first platform with the top surface of the second platform inclined at a determined angle front to back relative to the top surface of the first platform, said second foldable support means comprised of a pivotal connecting means forming a pivotal juncture between the lower end of the second platform and the upper edge of the first platform, and further comprised of a stop positioned on one of the first and second platforms in the path of the relative pivoting movement of the other of the platforms to abuttingly engage said other of the platforms and thereby to limit rearward pivoting of the second platform at the determined angle relative to the first platform, said stop comprising the sole support of the second platform at the determine angle, said second foldable support means further including a raised strip on the bottom of the second platform, and said pivotal connecting means forming a pivotal juncture between the raised portion of the strip and the upper edge of the first platform whereby in the open position the top surface of the second platform is offset rearwardly from the top surface of the first platform thereby forming a book supporting ledge, and said second foldable support means permitting the pivoting forwardly of the second platform to fold the top surface thereof onto the top surface of the first platform for carrying.

2. A portable desk top as defined in claim 1 wherein the first foldable support means includes a base member pivotally connected to the front edge of the first platform, and a support member pivotally connected to the back end of the base member that pivots into and out of supporting engagement with the back end of the first platform, all of said pivotal connections providing for collapsing of the second platform, first platform and the support member relative to the base member to thereby achieve a compact and portable structure for carrying.

3. A portable desk top as defined in claim 2 wherein the contrast of the exposed top surface areas of the first and second platform is within the range of two to three times greater than the surface area of white paper.

4. A portable desk top as defined in claim 2 wherein the base member is a platform adapted to rest on a flat desk top, the first platform has a top surface inclined relative to the base member within the angular range 20° to 30°, and the second platform has a surface inclined relative to the base member in the range of 60° to 80°.

* * * * *